US007637104B2

(12) United States Patent
Lopez

(10) Patent No.: US 7,637,104 B2
(45) Date of Patent: Dec. 29, 2009

(54) BUOYANCY ENGINE APPARATUS

(76) Inventor: Arthur V. Lopez, 36324 Capri Dr., Winchester, CA (US) 92596

( * ) Notice: Subject to any disclaimer, the term of this patent is extended or adjusted under 35 U.S.C. 154(b) by 422 days.

(21) Appl. No.: 11/604,968

(22) Filed: Nov. 27, 2006

(65) Prior Publication Data

US 2007/0183906 A1 Aug. 9, 2007

Related U.S. Application Data

(60) Provisional application No. 60/765,162, filed on Feb. 6, 2006.

(51) Int. Cl.
*F03C 1/00* (2006.01)

(52) U.S. Cl. ..... 60/495; 60/496

(58) Field of Classification Search ..... 60/495, 60/496

See application file for complete search history.

(56) References Cited

U.S. PATENT DOCUMENTS 4,675,536 A * 6/1987 Bellamy ..... 290/42
4,718,232 A * 1/1988 Willmouth ..... 60/495
4,981,015 A * 1/1991 Simpson ..... 60/496
5,685,147 A * 11/1997 Brassea ..... 60/496
6,018,947 A * 2/2000 DeMarco et al. ..... 60/496
6,208,035 B1 * 3/2001 Kao ..... 290/42

* cited by examiner

*Primary Examiner*—Hoang M Nguyen
(74) *Attorney, Agent, or Firm*—Donn K. Harms

(57) ABSTRACT

A buoyancy engine and compression device having a plurality of rotating flexible chains formed of individual segments, each having a plurality of compressible flotation members engaged thereon. The chains rotate around axises at upper and lower frames. The flotation members are alternately compressed and expanded during rotation around the upper and lower frames during passage through an angled pathway defined by paired planar members in an angled engagement which rotate in time with the chain and engaged flotation members. This alternating compression and expansion may also be utilized as an air compressor. Expanded flotation members circumventing the lower frame produce upward thrust as a function of their dimension and displacement of water. Mechanical energy from the system may be harnessed by conventional mechanical engagement of the rotating flexible chains or segments forming the upper and lower frames.

9 Claims, 12 Drawing Sheets

NOTE:

1. MODIFIED CIRCULAR PLANAR MEMBERS ARE NOT DEPICTED ON THIS DRAWING FOR SIMPLICITY.

$$\frac{X}{Y} = \frac{[(R+r) - D/2\cos\theta]}{[(R-r) + D/2\cos\theta]}$$

Where,

"R" = distance from point "M" to the center of the planar member
"r" = radius of the circular planar member
"D" = diameter of the collapsible floatation member
"2θ" = angles in degrees between two circular planar members

BUOYANCY ENGINE APPARATUS

FIELD OF THE INVENTION

This application claims the benefit of U.S. Provisional Application Ser. No. 60/765,162, filed on Feb. 6, 2006 which is incorporated herein by reference. The present invention is directed to a force transmitting apparatus providing an engine producing mechanical. The device as herein disclosed and described, relates to an apparatus employing the forces of buoyancy upthrust on a series of rotationally engaged floatation members to transmit a displacement force to a drive chain or chain engaging bellowed floatation members between two vertically displaced polygonal drive frames formed of individual linear segments. The resulting combined aggregate buoyancy upthrust from the engaged flotation members is utilized to impart rotational movement to mechanically engaged axles or belts.

BACKGROUND OF THE INVENTION

Industrialized countries throughout the world in the $20^{th}$ and $21^{st}$ centuries have an increased requirement for energy proportional to their populations and production of products for national and international consumption. Conventionally, water power such as dams and fossil fuels such as oil and gas, have provided the world with their main source of energy for industry and for every more energy dependent populations.

With the increase in the world's population and the industrial output of new industrialized nations such as China, combined with ever decreasing natural energy resources, there is an increasing need to find alternate energy sources. It is preferable if such sources are non-polluting due to the theory of global warming from burning fossil fuels and the problems with pollution that oil cause in the world's environment.

As a result, greater emphasis is increasingly being placed on creating more efficient mechanical devices which either operate more efficiently, or which produce energy, in an attempt to conserve current resources. However, it is currently being recognized that many alternative energy sources exist such as wind power, which are being under utilized. Further, many potential non-polluting, renewable natural energy resources, such as gravity and solar energy, are currently under exploited. The apparatus herein described and disclosed, utilizes the natural power of buoyancy to provide an upthrust upon a series of the bellowed floatation members and a unique manner of circulating the floatation members in a flexible chain, to produce a driving force which may be mechanically capture to power mechanical devices to do work.

As is well known, a floating body or member, such as a sealed hollow container, if held below the surface of water, and then released, will rise vertically upwards toward the surface. It is also conventionally known that the water exerts an upward force on the floatation member according to the Archimedes principle. This principle provides that the magnitude of the upward force exerted onto the floatation members is equal to the weight of water which is displaced by the volume of the floatation members. Further, if the total volume of a floatation member displaces water weighing less than the member itself, that member will sink.

As such, there is an ongoing need for new energy sources which take advantage of naturally available sources. Such a device should therefore be provided that will harness the energy provided by the natural upward rise of floatation members and other components which displace sufficient water or fluid and allow for recompressing of such floatation members with minimal energy loss to thereby provide a net gain in upward force which may be harnessed.

With respect to the above description, before explaining at least one preferred embodiment of the invention in detail, it is to be understood that the invention is not limited in its application to the details of construction and to the arrangement of the components or steps set forth in the following description or illustrations in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices, methods and systems for carrying out the several purposes of the present buoyancy engine. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

SUMMARY OF THE INVENTION

The device as herein described and disclosed, employs a unique indirect means to compress air or gas inside a hollow bellowed floatation member using indirect compression of the floatation members and gas sealed therein. While the specification herein refers to the hollow bellowed members as floatation members, this term is for convenience and alternate terms for the unique compressible members can also be employed. A segmented polygonal shape of upper and lower frames providing rotational engagement the chain-engaged floatation members and takes advantage of the principle that where forces which are equal and collinear, and are acting in opposite directions, they will not produce a resultant moment at any point in space. Consequently, the pre-pressurized hollow collapsible flotation members, rotationally engaged in a plurality of chained circular paths around both frames, are compressed starting at a widest point in their rotation around the segments of the upper frame section and decompressed beginning at the narrowest point of their rotation around the segments forming the lower frame section. The resulting rotationally engaged combination of compressed and enlarged floatation members, in a plurality of chained engagements to the frames, provide a net upward force to the flexible drive chains engaging each of the plurality of hollow compressible flotation members.

The above noted indirect compression is attained by the employment of circular members centrally engaged upon each linear segment or leg forming the top frame section. The individual segments forming both the upper and lower frames, are engaged to adjacent segments to form a polygonal frame with a generally circular shape. All of the segments forming each respective polygonal frame, rotate in tandem engaged to adjacent segments by means for flexible engagement such as a universal joint. The individual segments engaged to the circular members, the flexible drive chains engaged to the circular members, and dividing members engaged to the chains and sides of the floatation members, and other components engaged to the circular members or segments or chain, will all rotate at substantially the same speed.

A plurality of the flotation members having collapsible sidewalls are engaged between each pair of rotating flexible chains thereby providing means for rotation, translation and a spaced relationship, in between and around the upper and lower frame members in a generally circular path.

The circular planar members are engaged at a central portion of the individual linear segments substantially normal to the axis of individual linear segments. The polygonal shape provided by the individual segments causes the opposing side portions of each pair of circular planar members outside the circumscribed area of the upper and lower frames to be spaced a larger distance from each other than the respective opposite side portions rotating inside the circumscribed area of the frame. Dividing endwall members and the flexible chains on which they are engaged follow alternating narrowing and widening pathways during their rotation around the upper and lower frames. The result is a plurality of narrowing distances between each pair of planar circular members as they rotate on the upper frame from outside the circumscribed area to inside the circumscribed area, and, a plurality of widening distances as they rotate from the inside of the circumscribed area of the lower frame, toward the outside of the circumscribed area.

During rotation of the flotation members in chained or other means for segmented flexible engagement adjacent to each pair of planar circular members engaged to segments forming the upper frame segment, each of the pre-pressurized flotation members is compressed to a collapsed position following the path formed by the endwall members following the narrowing gap between the circular members engaged to the linear segments of the upper frame. In the collapsed position, the floatation members may have a volume that will displace water weighing greater than, equal to, or less than the weight of the floatation member itself.

Each of the plurality of floatation members is engaged between adjacent flexible chains or other flexible segmented engagement to positions wherein all the flotation members are horizontally aligned with respective adjacent floatation members engaged to adjacent flexible chain pairs. On all such engagements of the floatation members to the flexible chain segments, each flotation member is substantially equidistant from the preceding and subsequent flotation member in like engagement. The result is a plurality of flotation members in engagement with chain segments located a fixed distance from other such engagements on the plurality of paired chains, rotating between the narrowing and widening paths formed by the rotating circular members. As noted, all of the linear segments forming the upper and lower frames, are engaged to adjacent segment members in the frame, using means for rotational flexible engagement of the distal ends of the segments to adjacent segment distal ends, such as a universal or rotating joint. Consequently all components rotate around the segments forming both frames at the rotation speed of the segments.

The pressurized flotation members descending, in a mechanically locked collapsed position, from inside the circumscribed area of the upper frame, to the inside of the circumscribed area of the lower frame, thereafter rotate around the lower frame section from inside its circumscribed area to the outside. The path follows the path formed by the circular planar members engaged to individual segments forming the lower frame from a narrowest point to a widest point and each floatation member is caused to inflate to its pre-determined expanded dimension by releasing a mechanical lock and allowing the force of the compressed gas inside the sealed flotation member to expand the collapsed sides. As noted, this enlarged dimension yields a volume that displaces water weighing more than the weight of the flotation member, thereby producing an upward thrust on the enlarged flotation members. This upward thrust is communicated by all of the plurality of inline enlarged flotation members to their respective engagements to the flexible drive chains. Mechanical means for engagement to capture the force of the resulting rotating segmented drive chains, and communicate it, will thereby provide force to do work.

It is therefore an object of the present invention to provide an apparatus and method to produce power from the buoyancy upward thrust on a system of submerged flotation members which may be harnessed.

It is a further object of this invention to use a unique configuration of polygonal frames and compression components rotating in a circular engagement, to minimize energy loss during compression of the flotation members.

An additional object of this invention is the provision of such a buoyancy engine which is easy to develop, construct, maintain and operate.

These together with other objects and advantages which become subsequently apparent reside in the details of the construction and operation of the invention as more fully hereinafter described and claimed, reference being had to the accompanying drawings forming a part thereof, wherein like numerals refer to like parts throughout.

BRIEF DESCRIPTION OF THE DRAWINGS

The accompanying drawings which are incorporated in and form a part of this specification illustrate embodiments of the disclosed buoyancy engine and together with the description, serve to explain the principles of the invention.

DETAILED DESCRIPTION OF THE PREFERRED EMBODIMENTS

Figure 1:
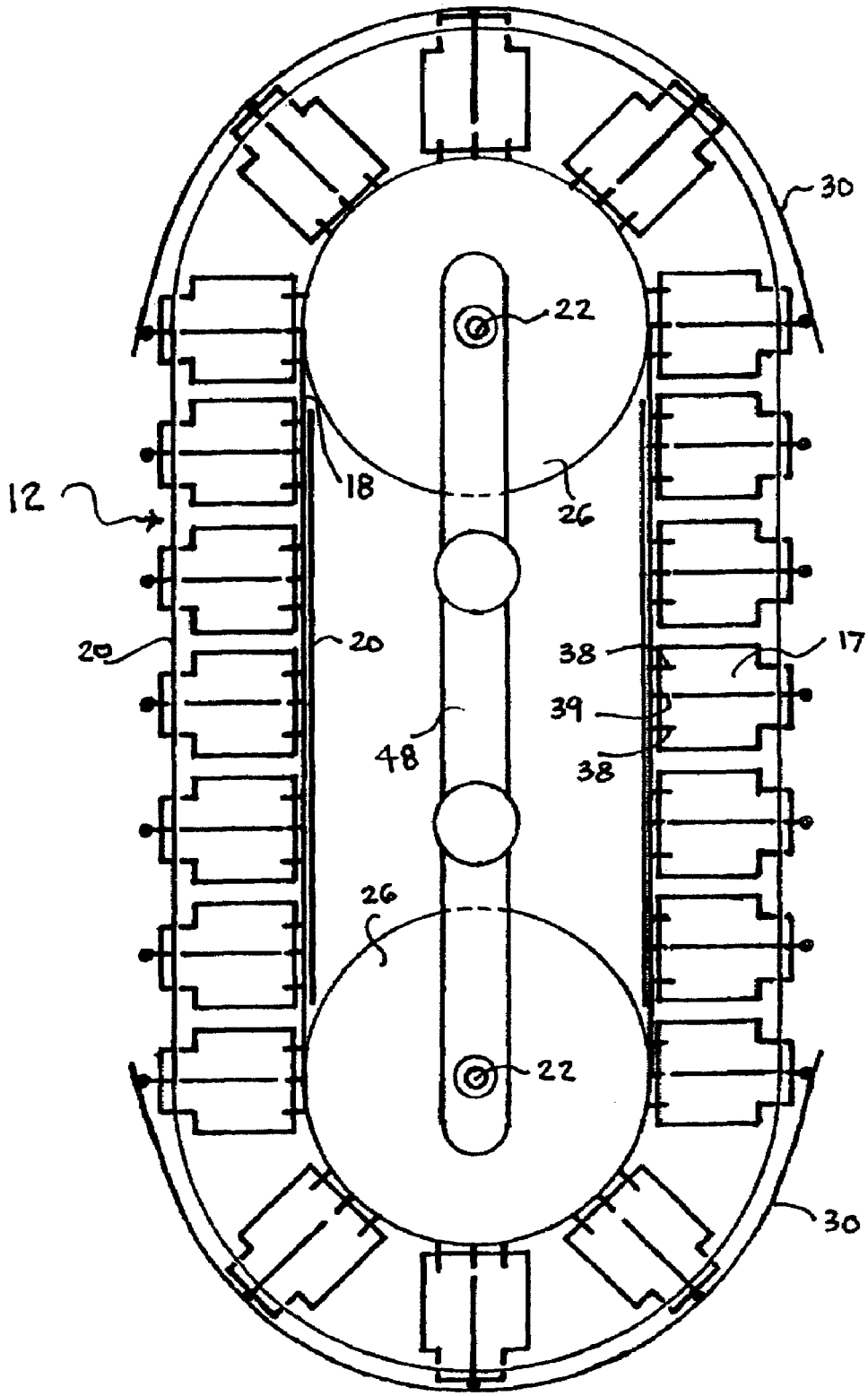
FIG. 1 depicts a side cut away view showing one engagement of circular rotating floatation members endwalls to the chain.
Figure 2:
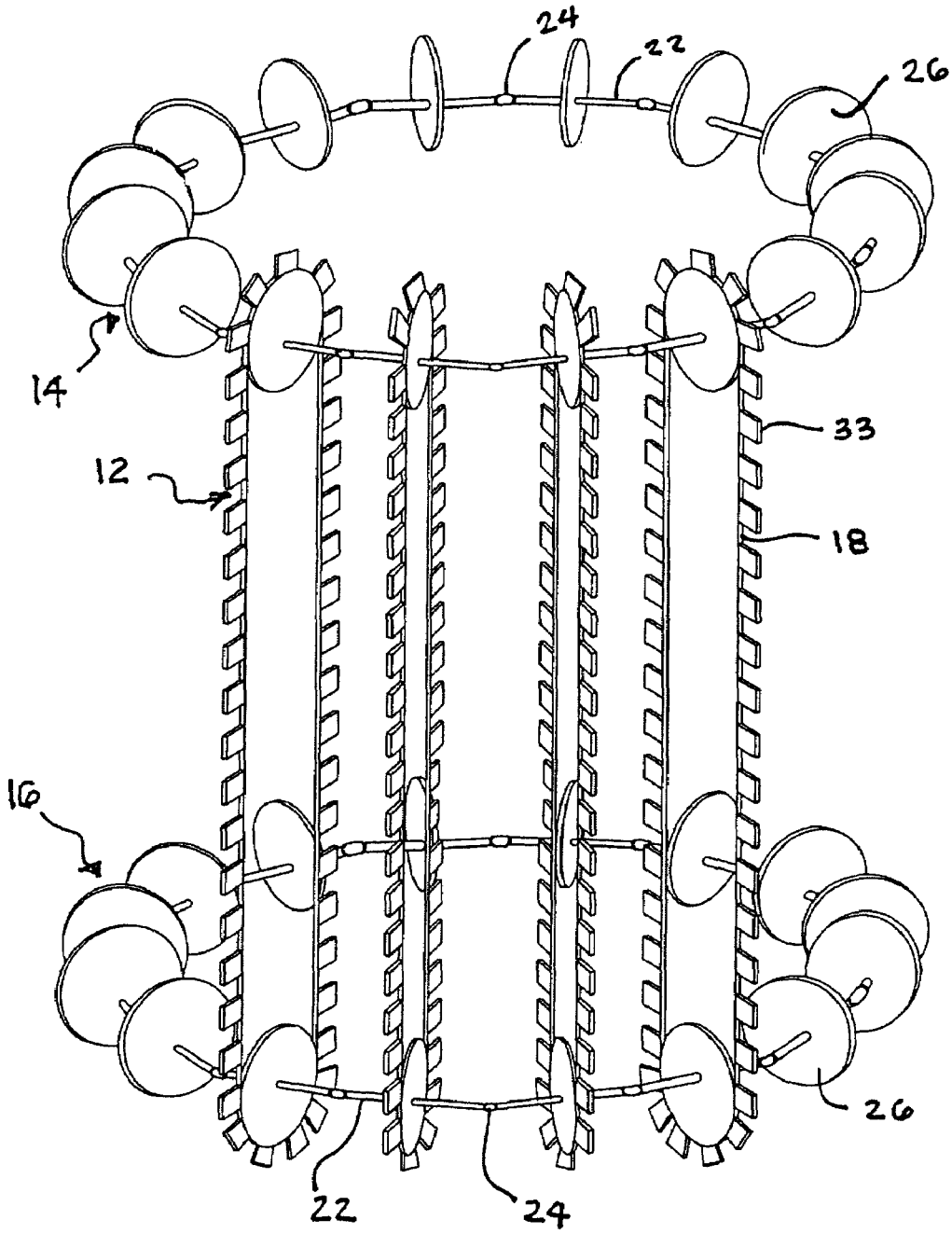
FIG. 2 depicts a partial perspective view of the rotational motion of the chain engaged floatation members endwall in between and around the upper and lower polygonal frames following the narrowing and widening pathways defined by the circular planar members and rails.

Referring now to the drawings FIG. 1-13, wherein similar parts are identified by like reference numerals, there is seen in FIGS. 1 and 2 side and side perspective views of a single segmented chain assembly 12 which when engaged in a plurality for rotation around an upper frame 14 and lower frame 16 provide a means for compression and expansion of a plurality of floatation members 17 engaged in a spaced positioning between a flexible chain 18 and side rails 20 or upper and lower eccentric rails 30. The chain is formed of individual segments of substantially equal length. The upper frame 14 and lower frame 16 are in a fixed spaced relationship using vertical risers 31 therebetween, or other structural means to maintain a fixed spacing.

The upper frame 14 and lower frame 16 are polygonal having a generally circular appearance and are formed of individual linear segments 22. The individual segments 22 which form the upper and lower frames, are engaged to adjacent segments 22 to form the polygonal frames using means for rotational engagement such as a universal joint 24. The segment 22 so engaged is adapted for rotational engagement with vertical support 48. The modified circular planar member 26, in fixed engagement with linear segment 22, is adapted for rotational engagement with vertical riser 31 which holds the upper and lower frames parallel to each other and at a fixed distance therefrom. The vertical risers are also adapted to be used as a main support structure wherein the other support member will be engaged.

The total number of segments 22 forming the upper and lower frame are equal such that both frames are the same size and when in a fixed engagement to the vertical risers 31 and vertical support 48, all the segments 22 of the upper frame 14 will be parallel and aligned with all of the respective segments 22 forming the lower frame. Some, or all of the segments 22 forming each respective polygonal frame, are adapted to rotate with vertical risers 31. The remaining linear segment 22 not in engagement with vertical riser 31 and modified circular planar member 26, will be supported by vertical support 48. Design considerations will determine if vertical risers 31 are positioned upon each segment 22 and its paired segment 22 on the opposite frame, or just some of them. The vertical risers 31 will also be employed to operatively maintain the device to the ground or mounting surface upon which it rests during operation.

Figure 3:
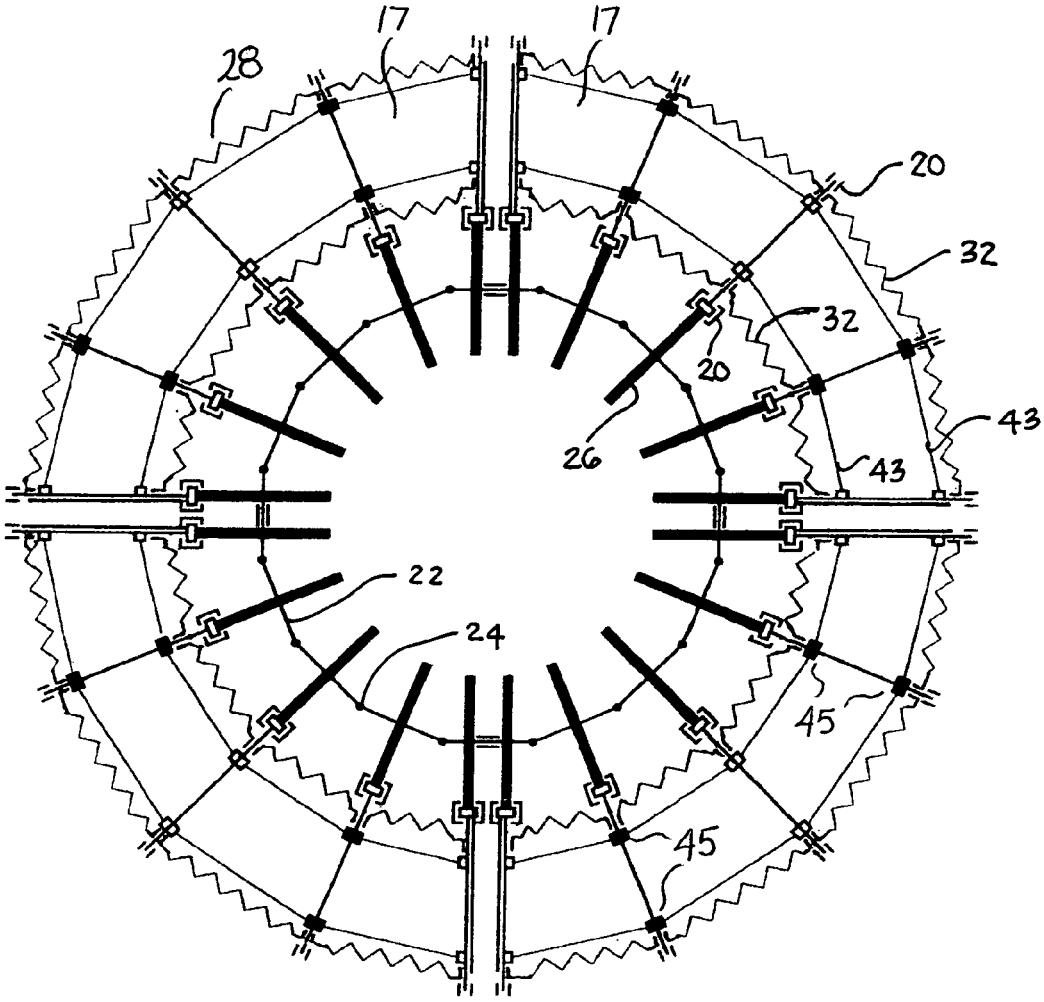
FIG. 3 depicts a top view of the device showing the plurality of floatation members in respective spaced engagements on respective flexible chains all engaged at the widest point of the pairs of angled circular planar members.
Figure 4:
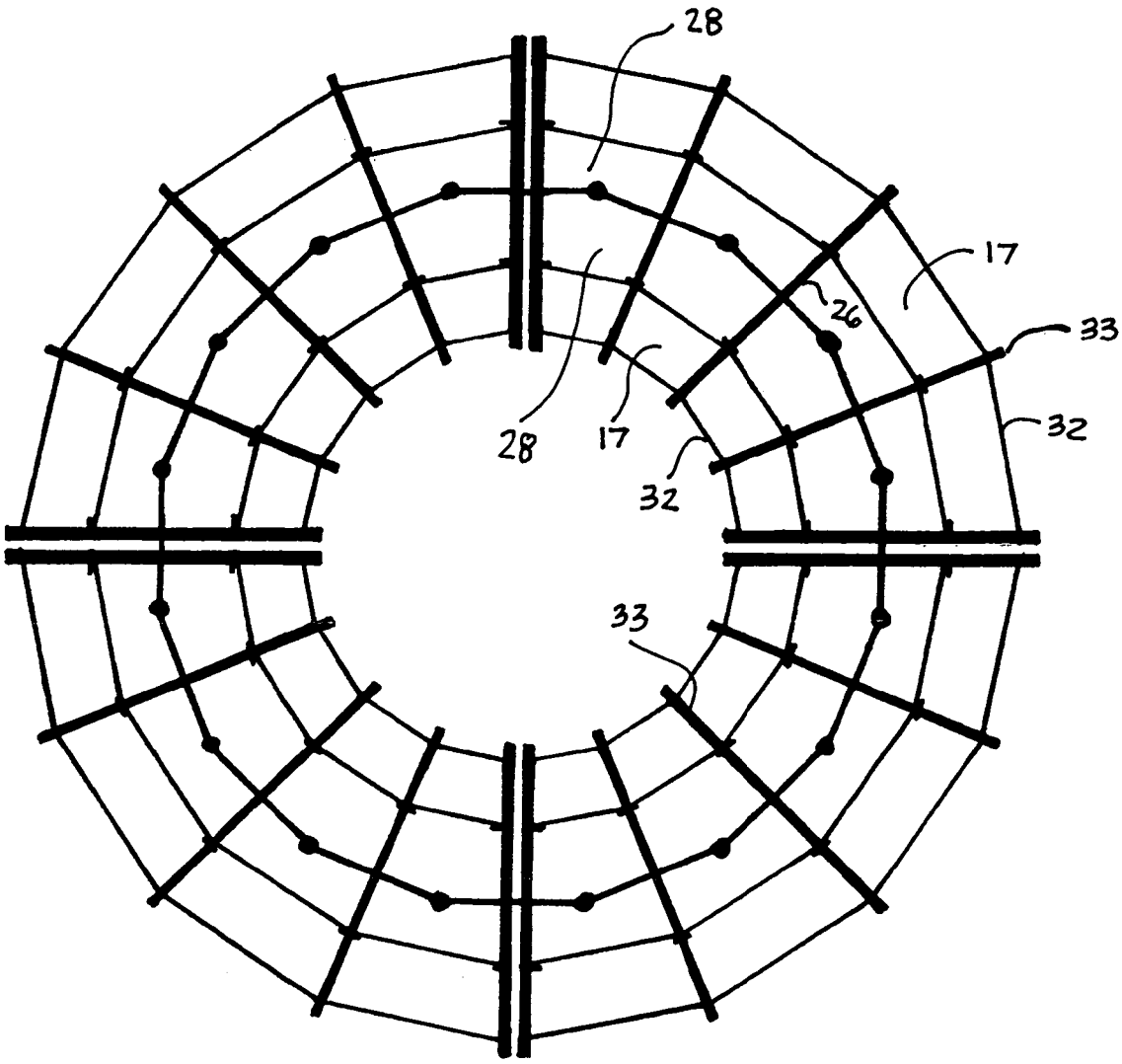
FIG. 4 is an end view of the one of a polygonal frame, showing the individual rotationally engaged segments and floatation members within the angled pathways defined by the circular members.

At a center section of each segment 22 is engaged one of a plurality of planar circular members 26 each being at an angle substantially normal to the axis of its respective engaged segment 22. As can be seen in FIGS. 3 and 4 the polygonal shape provided by the individual segments 22 forms an angled passage 28 between each pair of circular members 26. This angled passage 28 is wider outside the circumscribed area of the upper and lower frames and narrower inside the circumscribed area of the two respective frames.

Each of the circular members 26 being engaged to a central portion of each segment 22 rotate at the same speed as the segment 22 to which it is engaged. As noted the segments 22 forming the polygonal frames are linked at their distal ends to adjacent segments 22 and all rotate at substantially the same speed in unison. This imparts a like rotation at an equal speed to all of the engaged circular members 26.

The flexible chain 18 is operatively engaged to each circular member 26 and properly tensioned in a circular rotation around both the top frame 14 and lower frame 16 rotating at the same speed as the engaged segments 22 and circular members 26. Spaced from the perimeter of each circular member 26 on the upper and lower frame, and from the flexible chain 18 extending between inline circular members 26 on the top and bottom frames, are guide rails 20 that are each engaged a fixed position by operative mounting to the vertical risers 31 or other means for holding the rails 20 in a fixed engagement substantially parallel to each other. Eccentric rails 30 are in an eccentric spacing to both the upper and lower frames in relation to respective adjacent circular planar members 26. A bearing 34 or similar means for supported rotational engagement, provides means for engagement of the modified planar circular member 26 to the vertical risers 31 supporting the upper and lower frames. A bearing 46 or similar means for supported rotational engagement of the circular planar member 26 to the vertical support 48 supporting the linear segment 22.

A plurality of the floatation members 17 are engaged to the flexible chain 18 in a fixed spacing from other floatation members 17 in the plurality engaged to the chain 18. As such, as the chain 18 rotates in its engagement with the circular members 26, the floatation members 17 will rotate at the same speed, in their spaced relationship. The guide rails 20 are in operative slidable engagement with the floatation members 17 by means of rollers 40 operatively positioned on endwalls 33. The eccentric rails 30 are in operative slidable communication with the flotation members 17 using roller 40 positioned at the distal end of pin 42. The other guide rail 20 is in operative slidable engagement with the connecting pins 41 by means of roller 40 being operatively positioned at the ends of the connecting pins 41. Positioned along the chain 18 in the space between the inline circular planar members 26 of the upper and lower frames are rails 20 substantially parallel to the outer positioned rails 20 that are fixed in position by operative engagement to the vertical risers 31 or other means for holding the rails 20 in a fixed engagement substantially parallel to each other. The path defined by the planar member 26, the chain 18, and the rails 20 is the path that endwall 33 of the floatation members 17 will follow as the members 17 ascend and descend between the upper and lower frames and around the segments 22 of the upper and lower frames.

In this engagement with the chain 18 the floatation members 17 follow the path of the individual segments of the chain 18 in their rotation over the top of the upper frame 14 from outside its circumscribed area to inside its circumscribed area and thereafter toward the lower frame 16 where they follow the path of rotation from inside the circumscribed area of the lower frame 16 and around to outside of the circumscribed area, thereof.

Each of the floatation members 17 have sidewalls 32 having means for repeated compression and expansion such as a bellows 35 or accordion shaped of sidewall 32 and are formed of material adapted for continuous compression and expansion without failure from fatigue. This sidewall 32 thereby provides means to shorten the sidewall through compression on the endwalls 33 of the floatation members 17. This is a most preferred component of the device since the segmented polygonal shape of upper and lower frames providing rotational engagement the chain-engaged floatation members 17 takes advantage of the angled pathways defined by the angled positioning of the paired circular members 26 and the principle that where forces which are equal and collinear, and are acting in opposite directions, they will not produce a resultant moment at any point in space. As such, as noted above, the flotation members 17 being hollow bellowed such that they are adapted to change from an expanded position having a maximum volume to a collapsed position having a minimum volume, are urged to a compressed position starting at a widest point in their rotation around the segments 22 of the upper frame 14 section and subsequently decompressed beginning at the narrowest point of their rotation around the segments 22 forming the lower frame 16. The resulting rotationally engaged combination of compressed and enlarged floatation members 17, and employment of equal, opposite, and collinear forces on the narrowing and widening paths to change the dimensions of the members 17, and uniform rotation of the entire system, provide a net upward force to the chain assembly 12 engaging any plurality of the floatation members 17.

During rotation of each of the plurality of flotation members 17 in operative engagement with their respective chain assembly 12 through the angled pathway defined by each angled pair of planar circular members 26 each of the flotation members 17 is collapsed through equal opposite and collinear forces to a collapsed position while traversing the narrowing pathway around the upper frame 14. Once in this collapsed position, the floatation members 17 are held by means for restraining the floatation members 17 in the collapsed position as they descend toward the interior of the lower frame 16.

The flotation members 17 descending in the collapsed position from inside the circumscribed area of the upper frame 14 traverse through the interior of the lower frame 16 and thereafter rotate through a widening pathway defined by the angled positioning of the paired circular members 26 engaged to segments 22 on the lower frame 16. During traverse through this widening pathway, a release of the means to restrain the floatation members 17 in the collapsed position is affected thereby allowing sealed flotation members 17 to expand the collapsed sidewalls 32 as the floatation member 17 traverses around the circular planar member 26 on the lower frame 16 and thereby return to the expanded position.

As can be seen in FIG. 3 which is a top plan view of the device 10 the plurality of respective floatation members 17 are in respective spaced engagements between respective flexible chains 18 and rails 20 on the sides and proceed in a path around the planar members 26 where the chain 18 engaged to the endwalls 33 of the floatation members 17 follow the path defined by the chain 18 and rail 20 and planar members 26 rotating with the linear segments of the upper and lower frames. They, thus, move over the top of the upper frame 14 from outside its circumscribed area to inside its circumscribed area and thereafter toward the lower frame 16. A similar but a reverse path of rotation over the lower frame 16 is provided by the chain 18 and rail 20 and circular planar member 26 on the lower frame 16.

The narrowing pathways and employment of the equal, opposite and collinear force provided by the narrowing angled pathways 28 and rotating planar members 26 on the upper frame 14 provide a defined narrowing pathway yielding the compression for the floatation members 17 and as noted take advantage of forces which are equal and collinear, and are acting in opposite directions to compress the flotation members 17 as they traverse over the top of the upper frame 14.

The compression is accomplished as such, with little or no resistance force as the endwalls 33 of the flotation member 17 are compressed inward during travel through the angled passage 28 formed between the rotating planar members 26.

Figure 5:
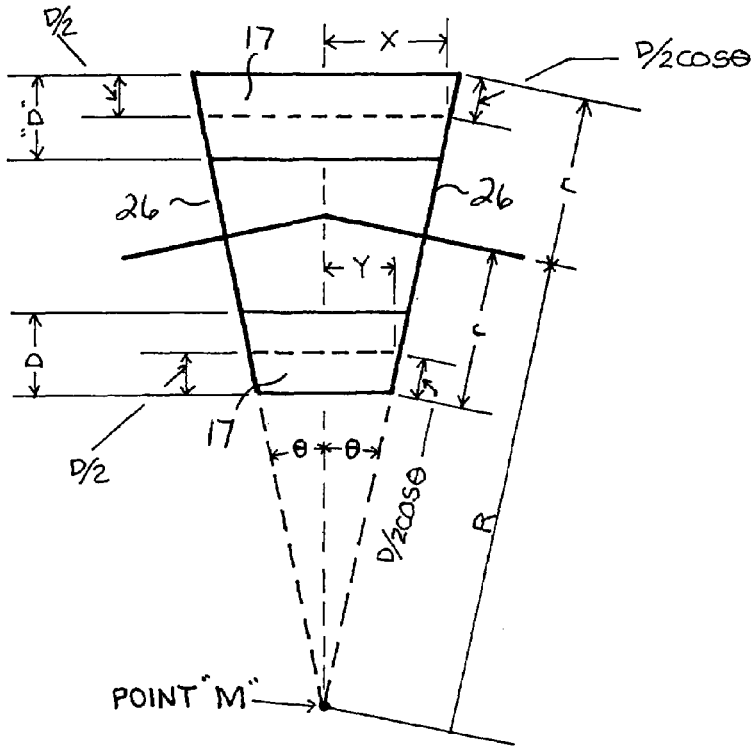
FIG. 5 depicts a graphical representation of the angles and dimensions involved between adjacent circular members when operatively engaged at a central portion of the individual segments forming the upper or lower frames.

A graphical representation and mathematical equation of the dimensional relationship between the indicated variables between adjacent circular planar members as shown in FIG. 5 where "R"=distance from point "M" to the center of a circular planar member 26, "r"—radius of the circular planar member 26, "D"=diameter of the collapsible floatation member 17

"2θ"=angle in degrees between two adjacent planar members 26

Also shown in FIG. 5 is the relationship between "R", "r" "θ" and "D" is defined by the equation below.

$$\frac{X}{y} = \frac{[(R+r) - D/2\cos\theta]}{[(R-r) + D/2\cos\theta]}$$

Letting X/y be expressed as compression ratio. (ratio of initial cylinder length to final cylinder length). Examination of the above equation will give the following conclusions:

1. Doubling "R" decreases the compression ratio.
2. Doubling "r" increases the compression ratio.
3. Doubling "θ" (small angles) produces insignificant changes on the compression ratio.
4. Doubling "D" decreases the compression ratio.

From the above equation, "r" has the greatest effect on the compression ratio, hence "r" will mostly dictate in the design of the device to yield the most substantial energy gain from the system.

Figure 7:
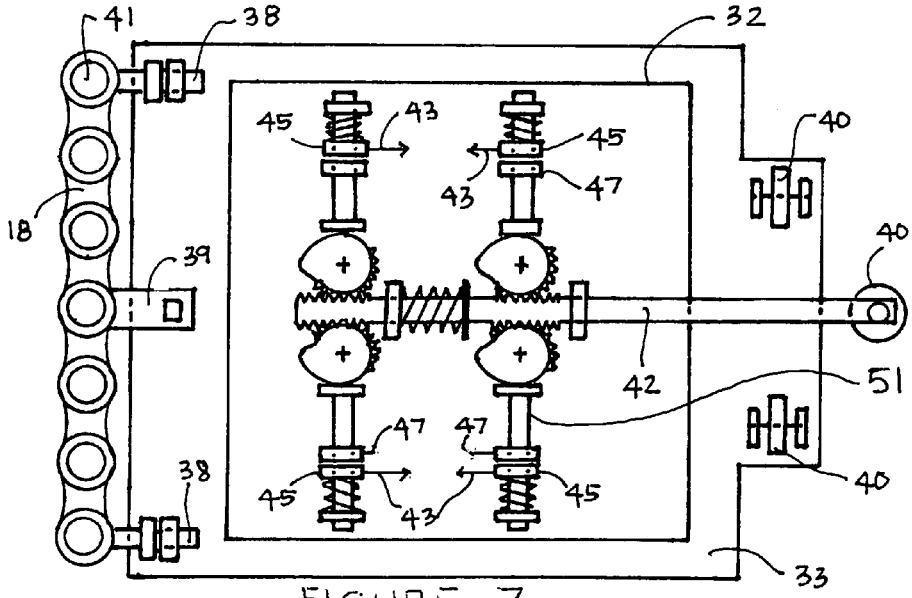
FIG. 7 shows an end view of the mechanism employed to lock the restraining cables in either extended or retracted positions by the pin activated by traversing the eccentric rails.
Figure 8:
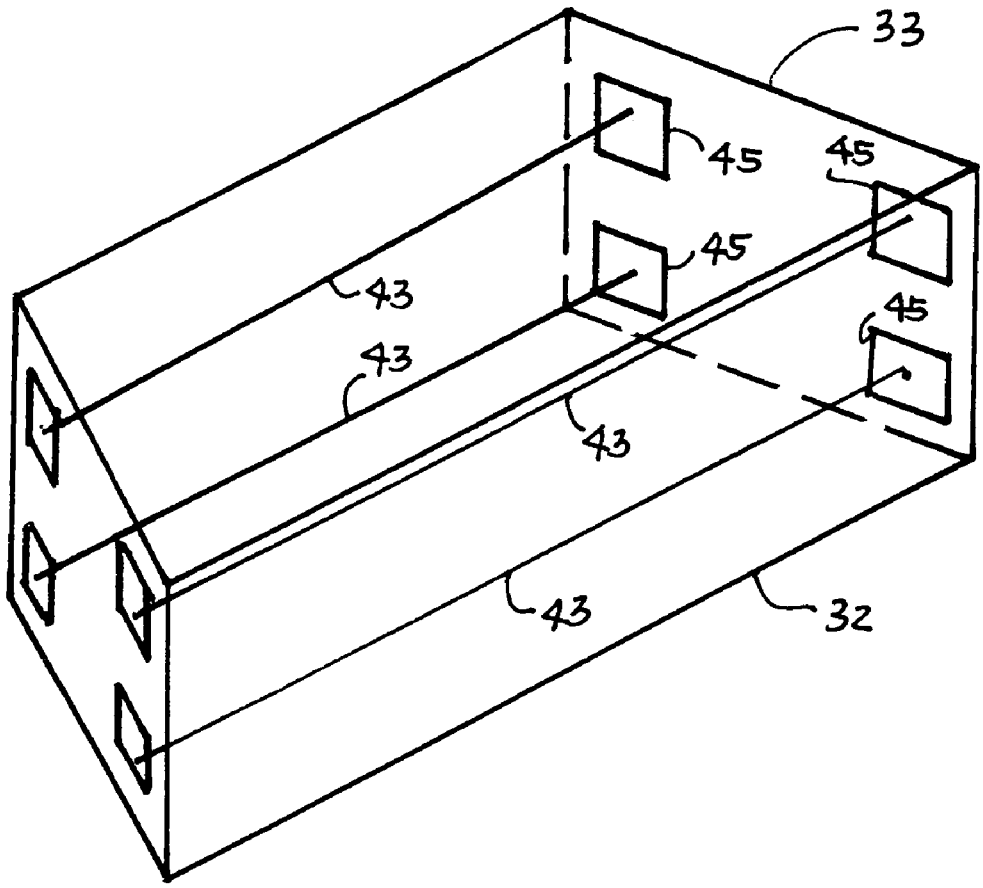
FIG. 8 shows internal retractable cables which provide a means to restrain the floatation members in both a collapsed state and when they enlarge.
Figure 9:
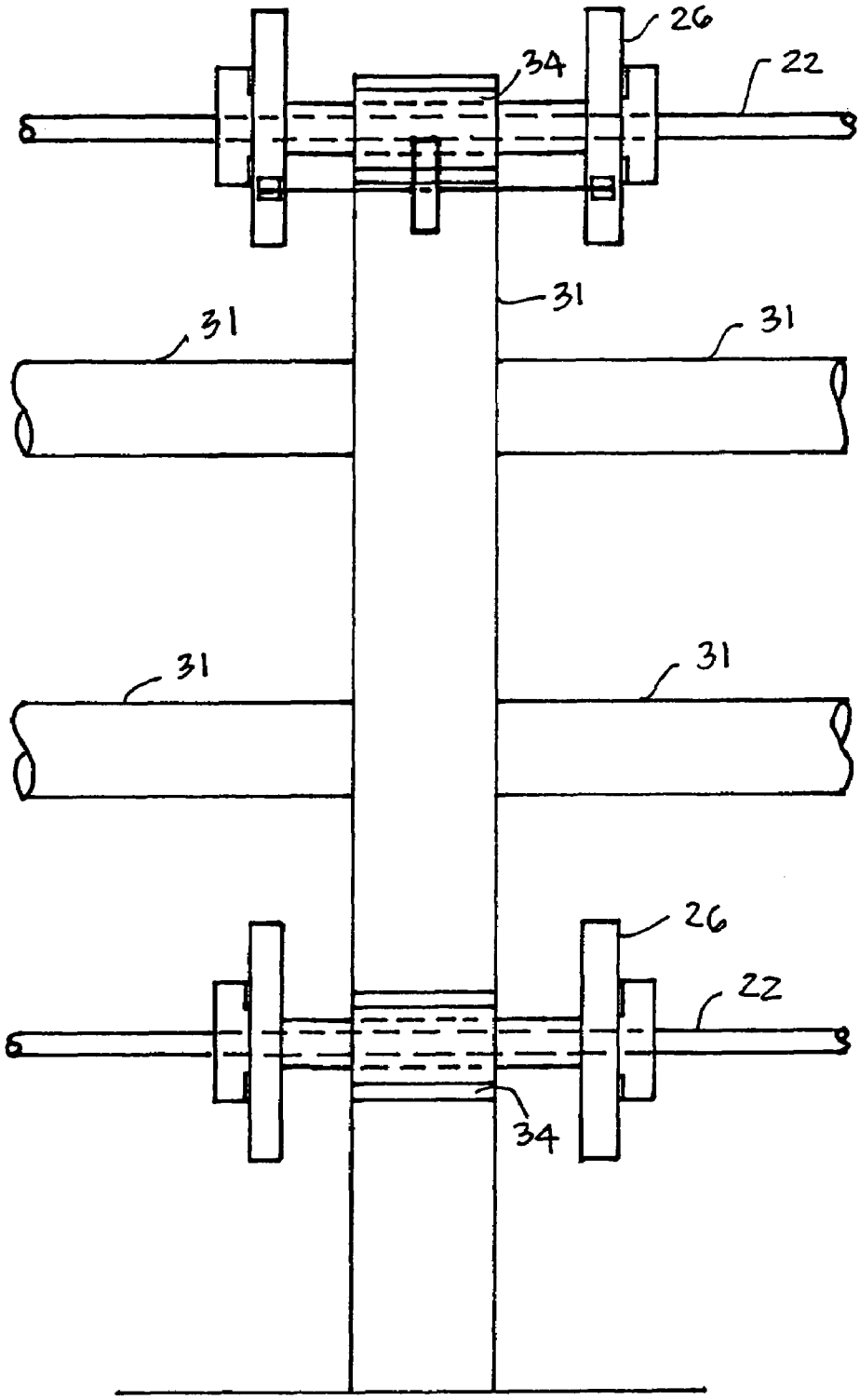
FIG. 9 shows a modified circular planar member in rotational engagement with vertical riser and support bearing.
Figure 10:
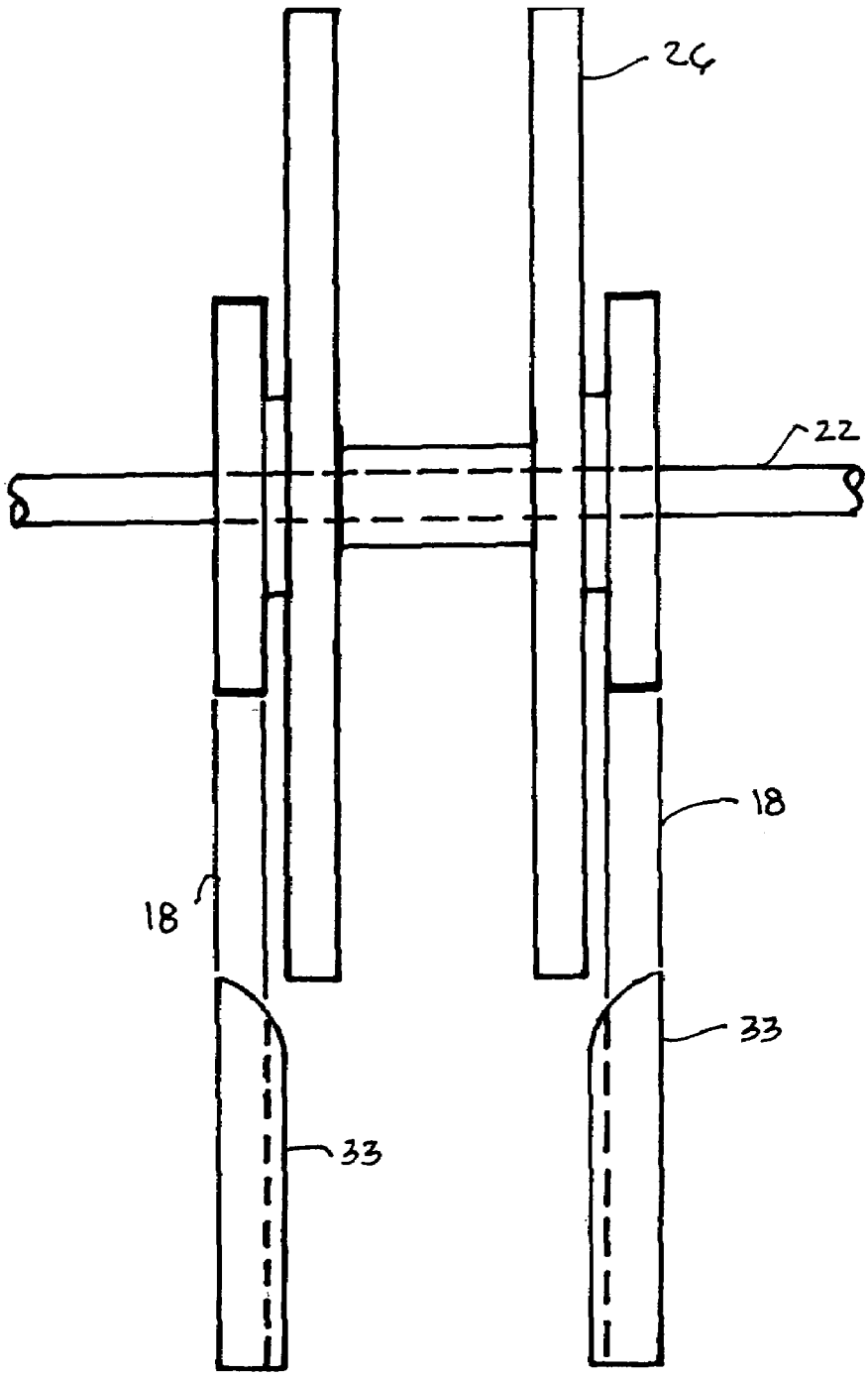
FIG. 10 shows a modified edge of the floatation member endwall for engagement with a modified circular planar member.
Figure 11:
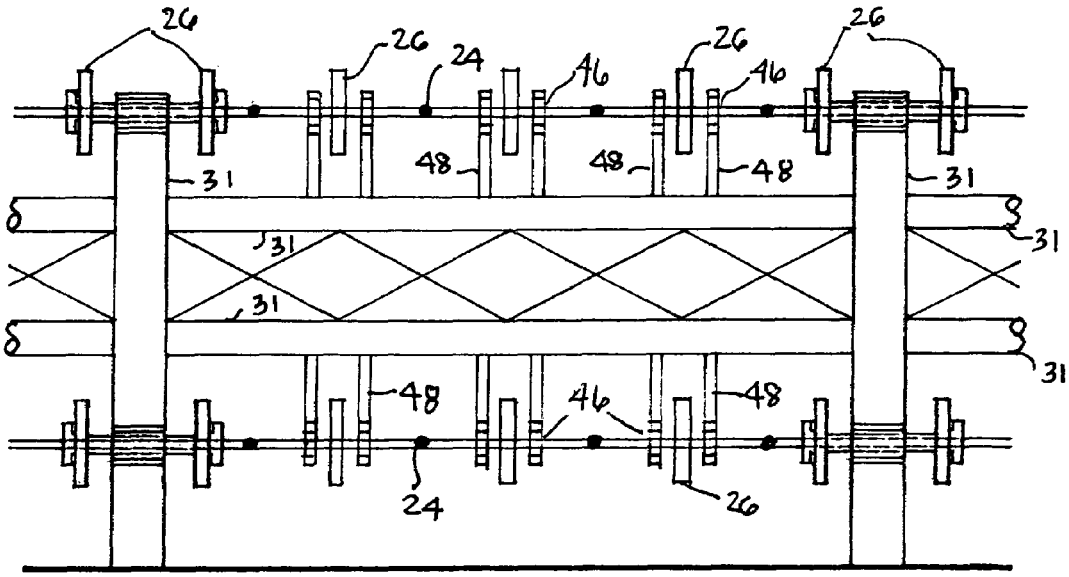
FIG. 11 shows a support arrangement for a non-modified circular planar member.
Figure 12:
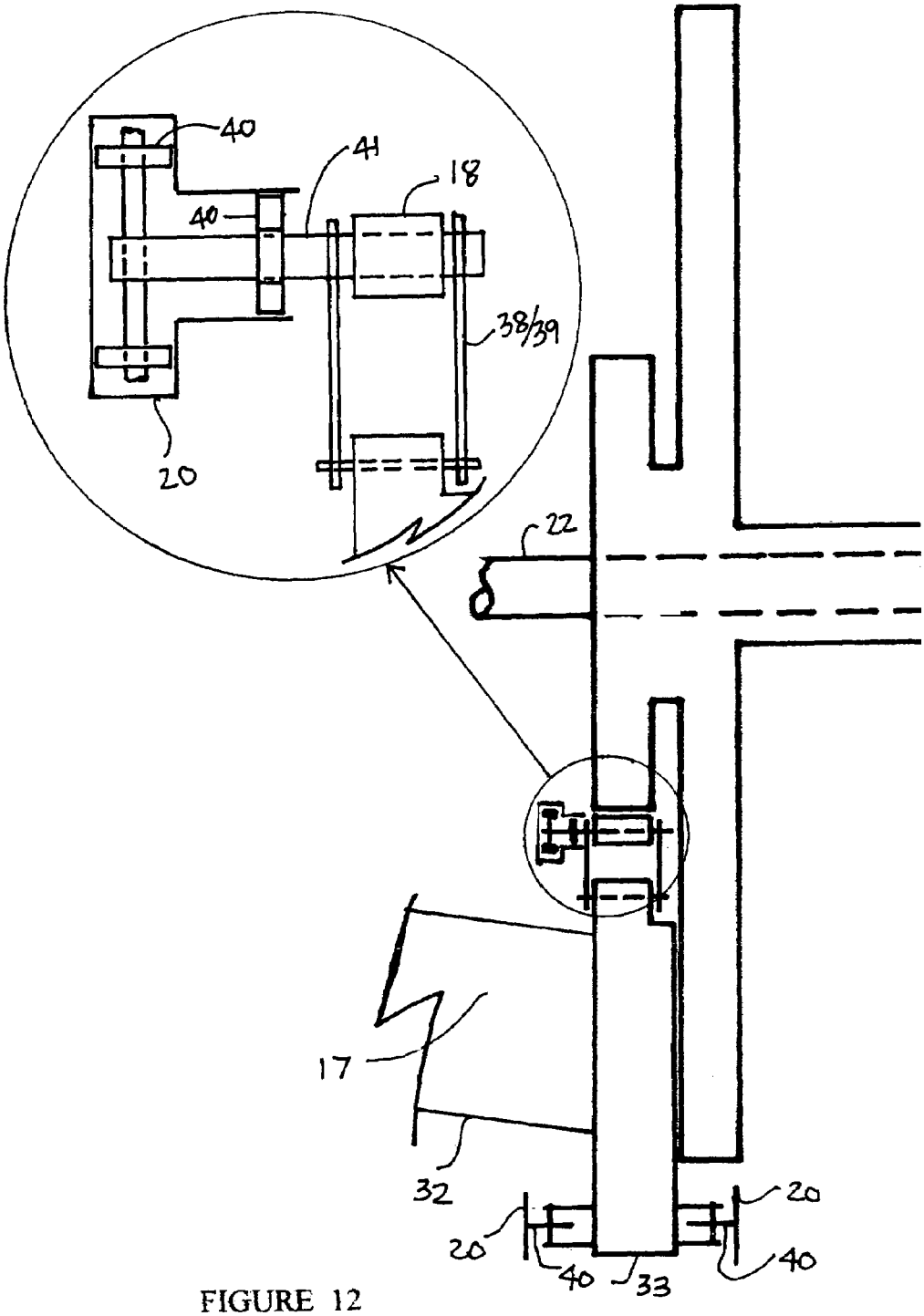
FIG. 12 shows a modified chain pin, guide roller, and rail guide for use in conjunction with a modified circular planar member.
Figure 13:
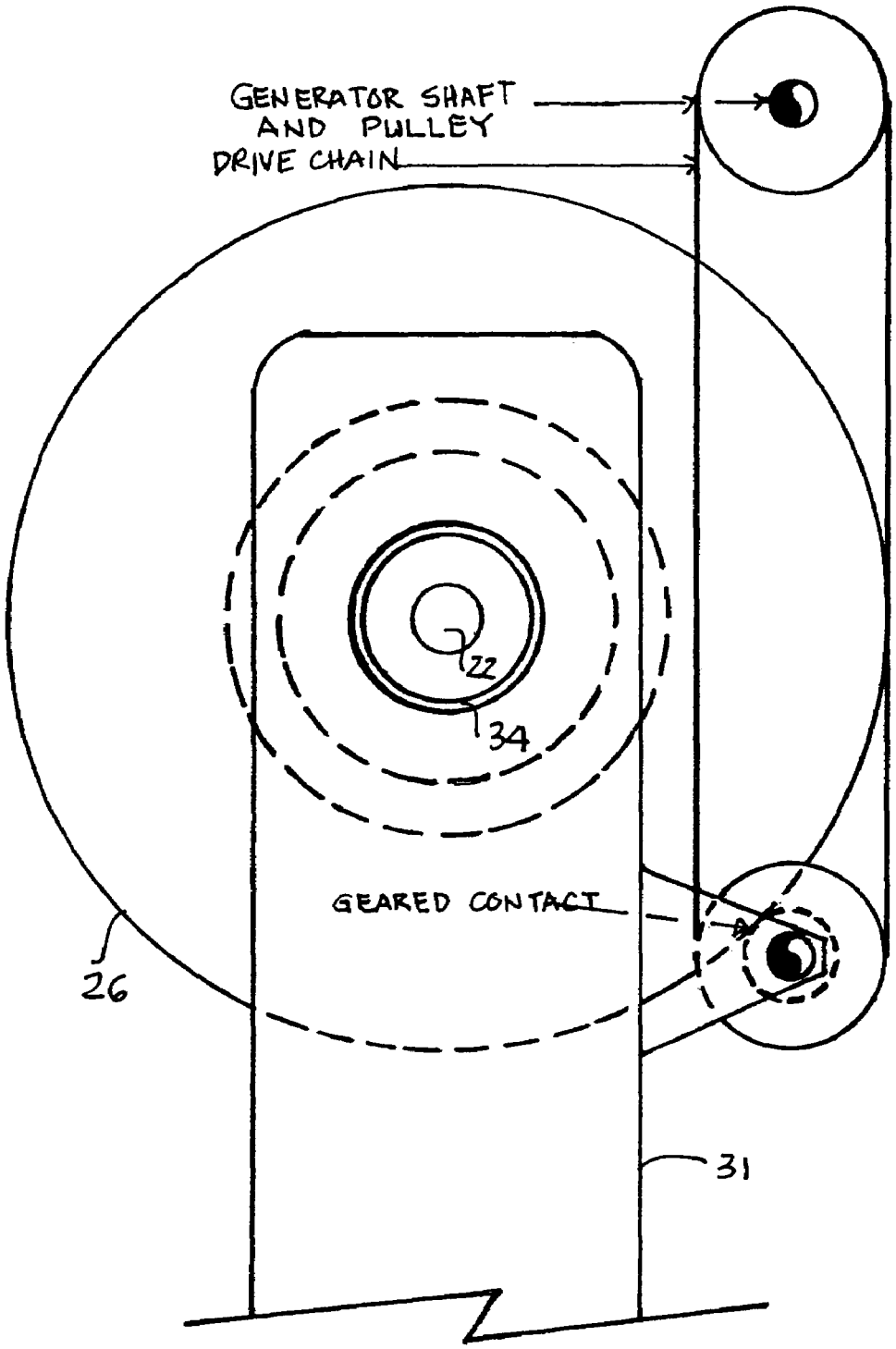
FIG. 13 show a power take-off arrangement.

FIG. 7 depicts the registered engagement of the plurality of floatation members 17 in their respective travel around the planar members 26 engaged with the segments 22 on the upper and lower frames, is provided by compression members 38 and 39. Compression members 38 and 39 are operatively engaged to the endwalls 33 of each floatation member 17 thereby providing means to compress the floatation members 17 to the collapsed position as they travel through the angled passage 28 on the upper frame 14.

During this travel the segments of the flexible chain 18 engaged to a sprocket or other means for engagement rotate at substantially the same speed as the rotation of the planar member 26 to which they are engaged. The first end of the compression members 38 are rotatably engaged to connecting pins 41 of segments of the chain 18 and the second end of the compression members 38 are slidably engaged to endwall 33 of the floatation member 17. The sliding engagement of compression members 38 will allow for the changing distance between endwall 33 and the connecting pins of the chain 18 as the floatation member rotates with circular member 26 around the segment 22 of the upper and lower frames 14 and 16. A stopper on member 38 is provided to maintain an equal gap between the chain 18 and the adjacent edge of endwall 33 when the chain 18 is not in contact with the circular planar member 26. Compression member 39 is rotatably engaged to the chain 18 on one end and on the opposite end is in a fixed engagement with the endwall 33. This rigid engagement to the endwall 33 provides a means to maintain the member 39 in a radial direction from the center of segment 22 and means to maintain at a fixed distance, the side of endwall 33 adjacent to chain 18.

Figure 6:
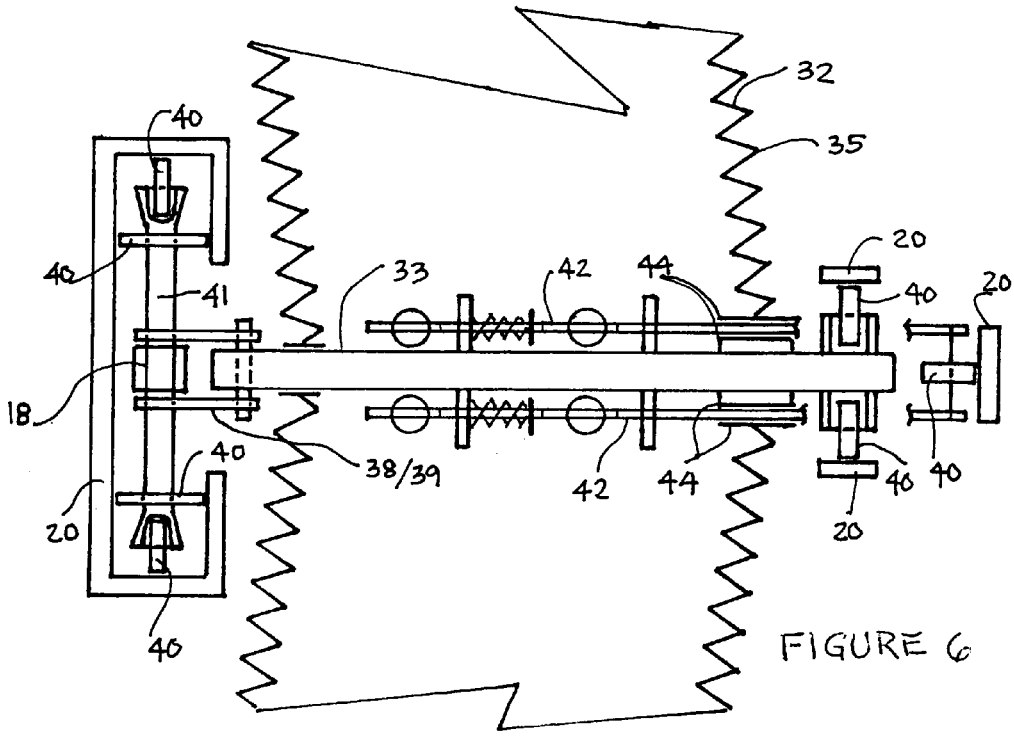
FIG. 6 shows a compression member endwall in operative engagement between the flexible chain drive and a flotation member adjacent to a rail in a parallel path.

Traversing the circular planar members 26 rotating with the segments 22 of the upper frame 14, as the pathway 28 narrows, the compression members 38 and 39 move the endwalls 33 of each floatation member 17 to the collapsed position. As best shown in FIGS. 6 and 7, during travel along the eccentric rails 30 on the upper and lower frames 14 and 16, a pin 42 is activated to affect engagement of internally located flexible cables 43 from a locked to an unlocked engagement. During the entire time the roller 40 on the pin 42 is in slidable engagement with eccentric rail 30, the means for volume restraint of the floatation members 17 provided by the cables 43 are in an unlocked position to allow the floatation members 17 to change between the expanded and collapsed position.

During traverse of any one floatation member 17 along the eccentric rail 30 on the upper frame 14 the floatation member 17 is collapsed as noted herein. A roller 40 engaged to the distal end of the pin 42, traverses the eccentric path of the rail 30 around the axis of the planar member 26 it surrounds. While traversing the upper frame, the roller 40 slidably engaged with the rail 30, translates the pin 42 toward the center axis of segment 22, where it disengages the cable housing 45 from the stop 47. The stop 47 when engaged provides a means to lock the cable housing 45 and the cable 43 extending from it. This allows the endwall 33 to follow the narrowing angled path 28 while the cable 43 changes length to accommodate the changing size of the floatation member 17.

The cables 43 as noted are located inside the sealed floatation members 17 and are biased to retract onto cable housings 45 operatively located inside the floatation members 17. As the floatation members 17 collapses as it rounds the upper frame around any respective planar member 26, the cables 43 are biased into the housings 45 by a biasing means such as internal springs or the like, whereafter the pin 42 is translated to activate the internal restraint mechanism to engage the stop 47 operatively with the housing 45 to maintain the housing 45 in position, and hold the cables 43 in a shorter state. The current preferred means for retracting and extending the cables 43 into fixed relative positions, is shown by restraint mechanism 51 shown in FIGS. 6 and 7 where the pin 42 activated by the roller 40 engaged with the eccentric rails 30 causes translation of the pin 42 to deactivate the restraint mechanism 51 to allow translation of the cables 43 to their respective retracted or extended positions from their housings 45. While shown as a series of operatively engaged levers cams and springs, those skilled in the art will realize that other means to restrain the cables 43 in either an elongated position in a longer state, or a retracted position in a shorter state, while the floatation members are traveling vertically along the rails 20 may be employed, and such is anticipated.

As the floatation member 17 rounds any planar member 26 located on the lower frame 16, the eccentric rail 30 engaged with the roller 40 translates the pin 42 toward the axis of the segment 22 moving the restraint mechanism 51 from the locked position to an unlocked position and allowing the cables 43 free to unwind from their housings 45 to the elongated position as the floatation member 17 expands and the endwalls 33 move away from each other to a point where they are fully extended to a pre-determined extended state. As the roller 40 on pin 42 ceases contact with rail 30 the cables 43 are restrained from further elongation by the locking mechanism 51 and provide a means to prevent the floatation members 17 from over expansion. This operation of the locking mechanism 51 to release and then secure the cables 43 to their position of extension from the housing 45, repeats during each traverse of the upper and lower frames. As noted the pin 42 extends beyond the boundaries of the sealed member 17. Means to seal the penetration of the pin 42 through the sidewall 32 as well as allow translational motion of the pin 42 through the sidewall 32 is provided by annular seal 44.

The method and components shown in the drawings and described in detail herein disclose arrangements of elements of particular construction, and configuration for illustrating preferred embodiments of structure of the present invention. It is to be understood, however, that elements of different construction and configuration, and using different steps and process procedures, and other arrangements thereof, other than those illustrated and described, may be employed for providing a buoyancy engine system in accordance with the spirit of this invention.

As such, while the present invention has been described herein with reference to particular embodiments thereof, a latitude of modifications, various changes and substitutions are intended in the foregoing disclosure, and will be appreciated that in some instance some features of the invention could be employed without a corresponding use of other features, without departing from the scope of the invention as set forth in the following claims. All such changes, alternations and modifications as would occur to those skilled in the art are considered to be within the scope of this invention as broadly defined in the appended claims.

Further, the purpose of the foregoing abstract of the invention, is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

I claim:

1. An apparatus for providing mechanical force comprising:

a polygonal upper frame member formed of a plurality of individual elongated linear segments each having distal ends engaged to distal ends of adjacent said segments, said upper frame defining an upper circumscribed area;

a polygonal lower frame member formed of a plurality of individual elongated linear segments each having distal ends engaged to distal ends of adjacent said segments, said upper frame defining an lower circumscribed area;

means for rotational angled engagement of said distal ends of said linear segments forming said upper frame, to adjacent said ends of said linear members;

means for rotational angled engagement of said distal ends of said linear segments forming said lower frame, to adjacent said ends of said linear members;

means for rotational support of said upper frame a fixed distance from a rotational support with said lower frame;

a plurality of pairs of upper circular planar members with one each of said pairs rotationally engaged at center portions of each said elongated members of said upper frame;

a plurality of pairs of lower circular planar members with one each of said pairs rotationally engaged at center sections of said elongated segments of said lower frame;

a first angle formed between each of said pair of upper circular planar members thereby forming a narrowing path therebetween, said narrowing path proceeding from a widest point outside said upper circumscribed area to a narrowest point inside said respective upper circumscribed area;

an equal second angle to said first angle formed between each of said pair of lower circular planar members thereby forming a widening path therebetween, said widening path proceeding from a narrowest point inside said lower circumscribed area to a widest point outside said respective lower circumscribed area;

a plurality of chains engaged for rotation with said upper circular planar members and said lower circular planar members whereby said chains and said circular planar members rotate at substantially a same speed;

a plurality of evenly spaced floatation members having endwalls in sealed engagement to a collapsible sidewall thereby defining an interior cavity;

said floatation members having an enlarged dimension with a maximum volume and a collapsed dimension of a minimum volume;

means of engagement of one of each endwall to a respective one of a pair of said plurality of chains, with each floatation member of each pair of chains aligned with adjacent floatation members of adjacent pairs of chains;

said floatation members engaged to each said pair of chains aligned with those of adjacent said pairs of chains for an inline rotation around said upper and lower frames and therebetween;

said narrowing path defined by said rotating upper circular planar members providing means to force said endwalls to collapse said sidewall thereby moving said floatation member to said collapsed dimension;

means to maintain said floatation members in said collapsed dimension;

means to release said floatation members from said collapsed dimension prior to travel through said widening path; and whereby said floatation members in said enlarged state impart an upward force to said plurality of chains.

2. The apparatus of claim 1, additionally comprising:

wherein said collapsible sidewall is provided by a bellows shape of said sidewall.

3. The apparatus of claim 1, additionally comprising a sprocketed engagement of said chains to said circular planar members.

4. The apparatus of claim 2, additionally comprising a sprocketed engagement of said chains to said circular planar members.

5. The apparatus of claim 3 wherein said means to maintain said floatation members in said collapsed dimension comprises:

a plurality of tethers located inside said interior cavity of each said floatation members;

said tethers extending from a biased retracted position wound on a reel engaged with a housing, to an extended position with a distal end extended a distance, from said housing;

said distal ends engaged to said endwalls of said floatation members;

means to lock said tethers in said retracted position; and means to release said tethers from said retracted position and relock said tether in said extended position, whereby said tethers in said retracted position maintain said floatation members in said collapsed position and in said extended position maintain said floatation members in said enlarged state.

6. The apparatus of claim 4 wherein said means to maintain said floatation members in said collapsed dimension comprises:

a plurality of tethers located inside said interior cavity of each said floatation members;

said tethers extending from a biased retracted position wound on a reel engaged with a housing, to an extended position with a distal end extended a distance, from said housing;

said distal ends engaged to said sidewall of said floatation members;

means to lock said tethers in said retracted position; and means to release said tethers from said retracted position and relock said tether in said extended position, whereby said tethers in said retracted position maintain said floatation members in said collapsed position and in said extended position maintain said floatation members in said enlarged state.

7. The apparatus of claim 5 wherein said means to means to lock said tethers in said retracted position and said means to release said tethers from said retracted and relock said tethers in said extended position comprise:

an elongated pin having a roller at a first end, and engaged to a locking mechanism in said housing at a second end;

said roller adapted for rolling engagement on a first eccentric rail adjacent to a circumference of said upper circular members;

said roller adapted for rolling engagement on a second eccentric rail, adjacent to a circumference of said lower circular members;

said second eccentric rail translating said pin from said locked position to allow a biased rotation of said reel to said extended position of said tether;

said first eccentric rail translating said pin from said relocked position to allow a biased rotation of said reel to said retracted position of said tether.

8. The apparatus of claim 6 wherein said means to means to lock said tethers in said retracted position and said means to release said tethers from said retracted and relock said tethers in said extended position comprise:

an elongated pin having a roller at a first end, and engaged to a locking mechanism in said housing at a second end;

said roller adapted for rolling engagement on a first eccentric rail adjacent to a circumference of said upper circular members;

said roller adapted for rolling engagement on a second eccentric rail, adjacent to a circumference of said lower circular members;

said second eccentric rail translating said pin from said locked position to an unlocked position to allow a biased rotation of said reel to said extended position of said tether;

said first eccentric rail translating said pin from said locked position to an unlocked position to allow a biased rotation of said reel to said retracted position of said tether.

9. An apparatus for providing mechanical force comprising:

a generally annular top frame, said frame formed of a plurality of individual linear members, each linear member rotationally engaged at two ends, to an adjacent linear member of said plurality;

said top frame having an area outside the circumscribed area and a circumscribed area;

a generally annular bottom frame, said frame formed of a plurality of individual linear members, each linear member rotationally engaged at two ends, to an adjacent linear member of said plurality;

said bottom frame having a lower circumscribed area substantially equal to said top frame;

a planar circular member having two side surfaces, located at center portions of each of said linear members of said top frame and said bottom frame;

means for rotational support of said top frame distance from a rotational support for said bottom frame;

adjacent said planar circular members, which are engaged to adjacent said linear members on said top frame thereby forming a plurality of upper pairs of planar circular members;

adjacent said planar circular members, which are engaged to adjacent said linear members on said bottom frame thereby forming a plurality of lower pairs of planar circular members, said lower pairs substantially aligned with said upper pairs;

a first angle formed between each of said upper pair of circular planar members thereby forming a narrowing path therebetween, said narrowing path proceeding from a widest point outside said upper circumscribed area to a narrowest point inside said respective upper circumscribed area;

an equal second angle to said first angle formed between each of said lower pairs of circular planar members thereby forming a widening path therebetween, said widening path proceeding from a narrowest point inside said lower circumscribed area to a widest point outside said respective lower circumscribed area;

a plurality of chains engaged for rotation with said pairs of upper circular planar members and said pairs of lower circular planar members whereby said upper and lower pairs of circular planar members at substantially a same speed;

a plurality of evenly spaced floatation members having endwalls in sealed engagement to a collapsible sidewall thereby defining an interior cavity;

said floatation members having an enlarged dimension with a maximum volume and a collapsed dimension of a minimum volume;

means of engagement of one of each endwall to a respective one of a pair of said plurality of chains, with each floatation member of each pair of chains aligned with adjacent floatation members of adjacent pairs of chains;

said floatation members engaged to each said pair of chains aligned with those of adjacent said pairs of chains for an inline rotation around said upper and lower frames and therebetween;

said narrowing path defined by said rotating upper pairs of circular planar members providing means to force said endwalls to collapse said sidewall thereby moving said floatation member to said collapsed dimension;

means to maintain said floatation members in said collapsed dimension;

means to release said floatation members from said collapsed dimension prior to travel through said widening path; and whereby said floatation members in said enlarged state impart an upward force to said plurality of chains.

* * * * *